US005551775A

United States Patent [19]

Parvin

[11] Patent Number: 5,551,775

[45] Date of Patent: Sep. 3, 1996

[54] TELESCOPIC DRAWER SLIDE WITH MECHANICAL SEQUENCING LATCH

[75] Inventor: Jackie D. Parvin, Pomona, Calif.

[73] Assignee: Accuride International, Inc., Santa Fe Springs, Calif.

[21] Appl. No.: 199,451

[22] Filed: Feb. 22, 1994

[51] Int. Cl.[6] ..... A47B 88/00

[52] U.S. Cl. ..... 312/334.11; 312/334.17; 312/334.25; 312/334.26; 312/334.33; 312/334.38; 384/18

[58] Field of Search ..... 312/334.11, 334.17, 312/334.25, 334.26, 334.33, 334.38; 384/18; 292/18, 228

[56] References Cited

U.S. PATENT DOCUMENTS

| | | | |
|---|---|---|---|
| 1,582,556 | 4/1926 | Stuck | 312/334.17 X |
| 1,963,220 | 6/1934 | Anderson | 312/334.11 |
| 2,606,090 | 8/1952 | Straubel | 312/334.11 |
| 2,655,422 | 10/1953 | Gussack | 312/334.11 X |
| 3,488,097 | 1/1970 | Fall | 312/334.11 X |
| 3,912,341 | 10/1975 | Stein | 384/18 |
| 4,272,139 | 6/1981 | Fler | 312/333 |
| 4,351,575 | 9/1982 | Röck et al. | 384/18 |
| 4,370,007 | 1/1983 | Fler | 312/333 |
| 4,469,384 | 9/1984 | Fler et al. | 312/322 |
| 4,537,450 | 8/1985 | Baxter . | |
| 4,549,773 | 10/1985 | Papp et al. | 384/18 |
| 4,560,212 | 12/1985 | Papp et al. | 384/18 |
| 4,563,044 | 1/1986 | Rees | 384/18 |
| 4,610,487 | 9/1986 | Delmege et al. | 384/18 |
| 4,662,761 | 5/1987 | Hoffman | 384/18 |
| 4,696,582 | 9/1987 | Kasten | 384/18 |
| 4,749,242 | 6/1988 | Rechberg | 312/334.11 X |
| 4,988,214 | 1/1991 | Clement | 384/18 |
| 4,998,828 | 3/1991 | Hobbs | 384/18 |
| 5,181,782 | 1/1993 | Wojcik | 384/18 |

FOREIGN PATENT DOCUMENTS

| | | |
|---|---|---|
| 2721231 | 11/1978 | Germany . |
| 2028109 | 3/1980 | United Kingdom . |

*Primary Examiner*—Peter M. Cuomo
*Assistant Examiner*—Rodney B. White
*Attorney, Agent, or Firm*—Christie, Parker & Hale, LLP

[57] ABSTRACT

A ball-bearing type drawer slide having proximal, intermediate and distal slide members extendable and retractable relative to each other. A latch is carried by a first of the slide members and is engageable with a locking element on a second of the slide members for restricting relative extension of the first and second slide members. The latch is engageable with an actuating element on the third slide member for disengaging the latch from the locking element.

8 Claims, 7 Drawing Sheets

TELESCOPIC DRAWER SLIDE WITH MECHANICAL SEQUENCING LATCH

BACKGROUND OF THE INVENTION

The invention pertains to ball bearing-type slides which are typically used to suspend a drawer in a desk, a filing cabinet or the like. More particularly, the invention pertains to slides having at least three slide members wherein the members are sequenced so that under certain conditions there is preferential movement of two slide members relative to a third.

A typical drawer slide has three slide members slidably secured to each other by a number of ball bearings riding in raceways formed on the slide members. For purposes of exposition, the slide member connected to the cabinet or other housing is designated the proximal slide member, the slide member affixed to the drawer is designated the distal slide member and the remaining slide member is designated the intermediate slide member. The drawer is supported by two slide mechanisms, one on either side, which slide mechanisms may be formed as mirror images of each other. When the drawer is in a closed position, the slide members will typically be in a nested configuration. When the drawer is pulled to a fully opened position, the slide mechanism will be in a configuration wherein the intermediate slide member is extended relative to the proximal slide member and the distal slide member is extended relative to the intermediate slide member.

In such basic slide mechanisms, the order in which the intermediate member extends relative to the proximal member and the distal member extends relative to the intermediate member is not necessarily predetermined. Considerations of strength and smoothness of operation may render a given order or sequence preferable in a given slide configuration. Activation of external mechanisms such as drawer locks may require a specific sequence of operation. A three part slide design is shown in U.S. Pat. No. 4,537,450 by Alan R. Baxter which provides sequencing action. That slide relies on two resilient latching members to cooperate in holding the slide members together during extension. A weakness of this design lies in the loss of elasticity of the resilient latch members. Another design of a telescopic rail with locking mechanism is shown in U.S. Pat. No. 5,181,782 by Thadeus H. Wojcik. That slide also relies on resilient fingers on a stop block member and the action of a second locking member. The design still depends upon the resilient nature of the fingers on the stop block and requires two cooperating latching members.

Regardless of the specific sequence, it is desirable that both slide mechanisms extend in the same order. This is so because for a given total extension of the slide mechanism, the strength, or vertical deflection under a given load, may be dependent on the specific relative extensions of the three members. Additionally, if left and right slide mechanisms have not extended in the same order, the drawer will have a tendency to tilt toward the weaker side. It is clear that the sequence upon extension is typically more important than the sequence upon reinsertion because a drawer is used only after extension whereas the reinsertion process is but a transitory one at the end of which both slides are of a necessity in the identical fully nested configuration.

In certain slides, a progression roller is carried by the intermediate member in rolling engagement with the proximal and distal members. This engagement necessitates a simultaneous extension of the intermediate member from the proximal member and the distal member from the intermediate member. Such an arrangement is featured in the Model 4032 drawer slide by Accuride International, Inc. In certain slide configurations, it is desirable that sequencing be provided upon reinsertion so that the distal member is reinserted relative to the intermediate member prior to the intermediate member being reinserted relative to the proximal member. This is particularly desirable in configurations wherein removal of the drawer is accomplished by completely disengaging the distal members from the intermediate members so that the drawer and distal members are removed as a unit. To properly reengage the intermediate and distal members it is thus desirable that the sequencing mechanism hold the intermediate members fully extended from the proximal members until the re-engagement has occurred. Once such slide which uses a rotating latch is disclosed in U.S. Pat. No. 4,560,212 by John E. Papp and Antony S. Reed.

BRIEF SUMMARY OF THE INVENTION

In a new invention, a telescopic drawer slide can be made using a single latch member which does not rely on resilient members for its action. Accordingly, to provide for sequential extension of the intermediate and distal slide members from the proximal slide member, the intermediate slide member carries a rotatable latch which is engageable with a locking slot on the distal slide member and an actuating ramp on the proximal slide member. In operation, the latch locks the intermediate and distal slide members to be initially extended as a unit relative to the proximal slide member. At a certain point in the extension, the latch engages the actuating ramp which disengages the latch from the slot thereby permitting the distal slide member to extend relative to the intermediate slide member.

BRIEF DESCRIPTION OF THE DRAWINGS

The features of the specific embodiment of the best mode contemplated of carrying out the invention are illustrated in the drawings, in which.

DETAILED DESCRIPTION

For purposes of exposition, various directional terms are used herein to describe a drawer slide in a common operative orientation for suspending a drawer in a cabinet. The terms "vertical" and "horizontal" are to determine the normal gravitational frame of reference for an upright cabinet having a horizontally extending drawer with a slide mounted at either side of the drawer. The term "forward" designates the direction in which the drawer is pulled from the cabinet. The direction "rearward" and the positions "front" and "rear" follow naturally. Similarly, the term "inboard" (or more particularly "laterally inboard") designates a position which is relatively close to the drawer and the term "outboard" designates a position relatively close to the side of the cabinet or other housing.

It is clear that an isolated drawer slide may be viewed in a variety of orientations. Accordingly, unless specifically indicated to the contrary, the use of such directional terms should not be regarded as limiting the absolute orientation of the slide but only establishing such relative orientation of various slide elements as follows from the consistent use of the directional terms.

Figure 1:
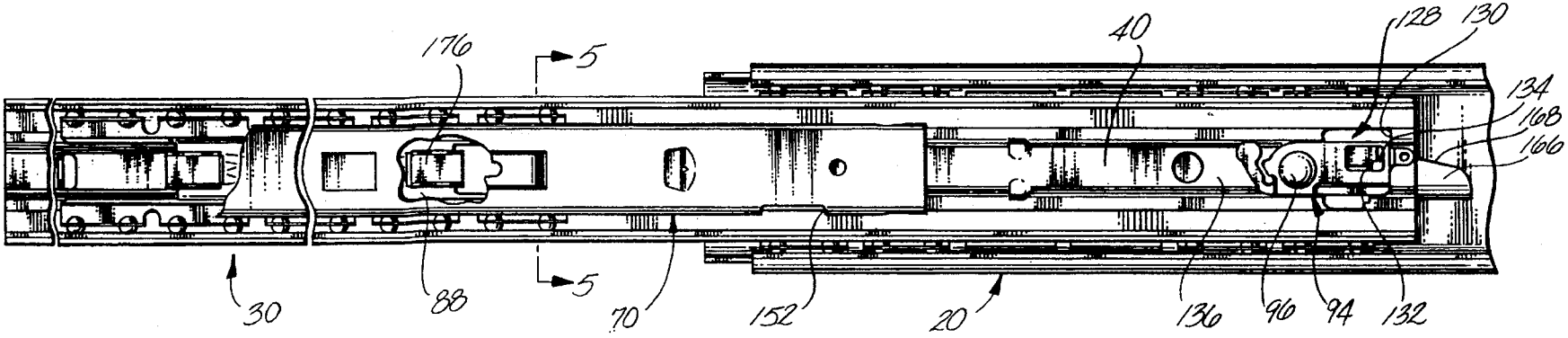
FIG. 1 is an inboard side elevational view of a drawer slide according to principles of the present invention shown in a substantially opened configuration.
Figure 4:
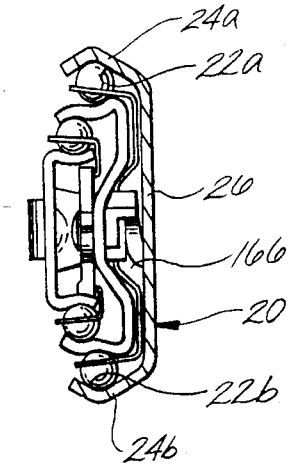
FIG. 4 is a cross-sectional view of the drawer slide of FIG. 2 taken along line 4—4.

As shown in FIG. 1, a drawer slide has a proximal slide member 20 which may be secured to a cabinet or other housing by any suitable means. The proximal slide member is of generally C-shaped cross-section (FIG. 4). The proximal slide member has a pair of upper and lower bearing raceways 22*a* and 22*b*, respectively, the upper raceway facing down and lower raceway facing up. Collectively the pair may be said to face vertically inward. The pair of upper and lower raceways 22*a* and 22*b* are formed in the top and bottom portions 24*a* and 24*b* of the proximal slide member which portions are connected by a substantially flat vertical web 26 forming the outboard side of the slide member which is secured to the cabinet.

An intermediate slide member 30 (FIG. 1) has a first pair of upper and lower bearing raceways 32*a* and 32*b* (FIG. 6), respectively, facing vertically outward and a second pair of upper and lower bearing raceways 34*a* and 34*b*, respectively, facing vertically inward and located inboard of the first pair. The first and second pairs of upper and lower bearing raceways are formed by respective outer and inner surfaces of top and bottom portions 36*a* and 36*b* of the intermediate slide member. The top and bottom portions are connected by a web having upper and lower flat vertical portions 38*a* and 38*b* connecting to outboard edges of the respective top and bottom portions. The web has a central flat vertical portion 40 located inboard of the flat vertical portions 38*a* and 38*b* and connected thereto by upper and lower connecting portions 42*a* and 42*b*, respectively.

A first plurality of upper and lower ball bearings 50*a* and 50*b* are respectively in rolling engagement with the upper and lower raceways of the proximal slide member and with the first pair of upper and lower raceways of the intermediate slide member. The first plurality of bearings is held by a first bearing retainer having top and bottom portions 54*a* and 54*b* formed with pockets for receiving the bearings. The top and bottom portions of the retainer are connected by a web configured to fit between the webs of the proximal and intermediate slide members, respectively. The web has upper and lower flat vertical portions 58*a* and 58*b* connecting to outboard edges of the respective top and bottom portions 54*a* and 54*b*. The web has a central flat vertical portion 60 located inboard of the flat vertical portions 58*a* and 58*b* and connected thereto by upper and lower connecting portions 62*a* and 62*b*, respectively.

Figure 5:
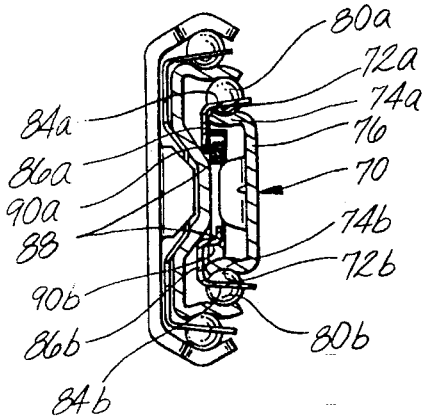
FIG. 5 is a cross-sectional view of the drawer slide of FIG. 1 taken along line 5—5.

A distal slide member 70 (FIG. 1) may be secured to the drawer or other suspended body by any suitable means. As shown in FIG. 5, the distal slide member is of generally C-shaped cross-section. The distal slide member has a pair of upper and lower bearing raceways 72*a* and 72*b*, respectively, facing vertically outward and formed in respective top and bottom portions 74*a* and 74*b* of the distal slide member. The top and bottom portions are connected by a substantially flat vertical web 76 forming the inboard side of the slide member which is adjacent to the drawer (not shown).

A second plurality of upper and lower ball bearings 80*a* and 80*b* are, respectively, in rolling engagement with the upper and lower raceways of the proximal slide member and with the second pair of upper and lower raceways of the intermediate slide member. The second plurality of bearings is held by a second bearing retainer having top and bottom portions 84*a* and 84*b* formed with pockets for receiving the bearings. The top and bottom portions of the retainer are connected by a web having upper and lower flat vertical portions 86*a* and 86*b* connecting to outboard edges of the top and bottom portions. The web has a central flat vertical portion 88 (FIG. 1) located inboard of the flat vertical portions 86*a* and 86*b* (FIG. 5) and connected thereto by upper and lower horizontal connecting portions 90*a* and 90*b*, respectively.

In the specific known slide configuration with which the present invention is illustrated, all three slide members are of generally C-shaped section. Due to their nesting relationship, the distal slide member is known as an inner slide member and the proximal slide member is known as an outer slide member. Because it is intermediate both in terms of extension and nesting, the intermediate slide member retains its designation as an intermediate slide member.

As shown in FIG. 1, a latch 94 is carried by the intermediate slide member. The latch is pivotally mounted to the intermediate slide member by means of a rivet 96 extending into the central portion 40 of the intermediate slide member's web.

Figure 7:
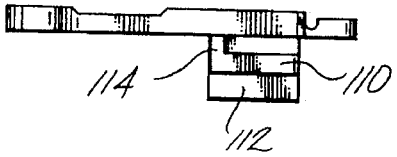
FIG. 7 is a bottom-elevational view of a drawer slide latch.
Figure 8:
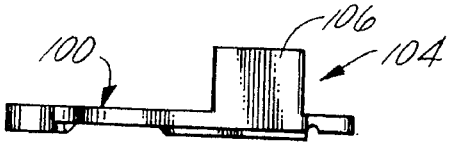
FIG. 8 is a top-elevational view of the latch of FIG. 7.
Figure 9:
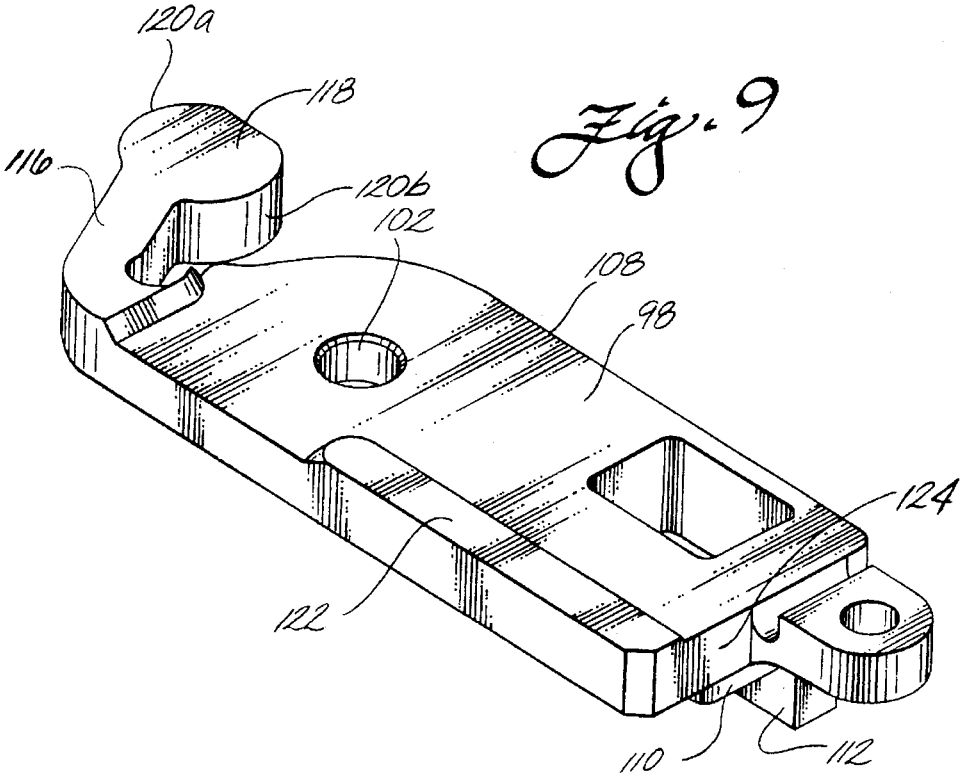
FIG. 9 is a perspective view of the latch of FIG. 7.

As shown in detail in FIGS. 7–9, the latch has a substantially flat vertical body 98 with a planar outboard surface 100. A pivot hole 102 extends perpendicularly through the body for receiving the rivet 96 (FIG. 1) to pivotally mount the latch to the intermediate slide member. A projection 104 (FIG. 8) connects to the body at a location above and behind the pivot hole and projects perpendicular to the body from the planar outboard surface 100. The projection comprises an upper plate portion 106 oriented substantially horizontally and extending perpendicular to the body from adjacent the upper edge 108 (FIG. 9) of the body. The projection has a side plate portion 110 extending downward from the lower surface or under side 112 of the upper plate portion and is oriented parallel to the body. A connecting web portion 114 (FIG. 7) of the latch extends between the side plate portion at its outboard edge, the body at its inboard edge and the upper plate portion at its upper edge adjacent to the forward edges of the side plate portion and upper plate portion.

A spring arm 116 (FIG. 9) extends forward and upward from the lower forward corner of the latch body which is located forward of and below the pivot hole 102. The distal end of the spring arm is formed by an enlarged section 118 having rounded front and back contours 120*a* and 120*b* , respectively. The front contour 120*a* forms the forwardmost surface of the spring arm which is located forward of and above the pivot hole 102. The spring arm is formed thicker than the latch body, having a flat inboard surface slightly elevated from that of the body. The latch has another thicker portion 122, wherein the inboard surface is similarly elevated, extending along the lower edge of the body from just behind the pivot hole to a rear end 124 of the body.

As shown in FIG. 1, the central portion 40 of the intermediate slide member's web has a hole 128 located behind the rivet 96. The rear profile of the hole has a step shape comprising a straight, vertical upper portion 130, a vertical lower portion 132 located forward of the upper portion and an upward facing horizontal shelf portion 134 extending between the upper and lower portions.

With the latch operably mounted to the intermediate slide member, the outboard surface 100 of the latch lies flat against the inboard surface 136 of the central portion of the intermediate slide member's web. The projection 104 of the latch extends through the hole 128 so that the upper plate portion 106 of the latch straddles the horizontal shelf portion 134 with the side plate portion 110 of the latch positioned just outboard of the central portion of the intermediate slide member's web.

Figure 10C:
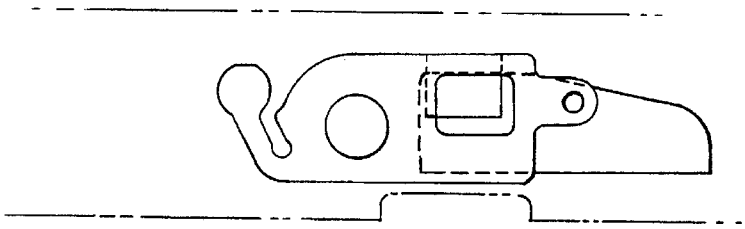
FIGS. 10 a–c are semi-schematic views of a drawer slide latch and actuating ramp in a disengaged, partially engaged and fully ingaged configuration, respectively.

As is described further below, the latch is rotatable from a first position shown in FIG. 10*a* through a second position shown in FIG. 10*c*. In the first position, the latch slopes downward and to the rear with the underside of the upper plate portion resting on the horizontal shelf portion of the rear profile of the hole 128. In the second position, the latch is in an essentially horizontal orientation so that its aforementioned front and back and upper and lower positions and directions correspond to the directions defined by the slide.

Figure 2:
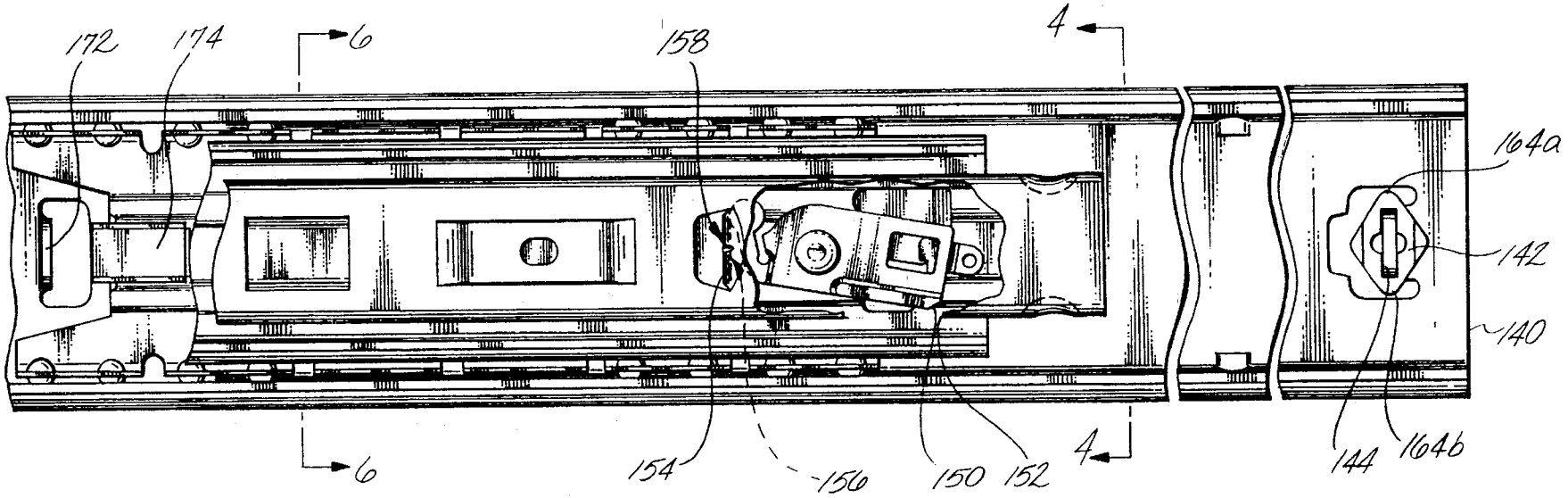
FIG. 2 is a partial side elevational view of the drawer slide of FIG. 1, shown in a partially opened configuration.
Figure 3:
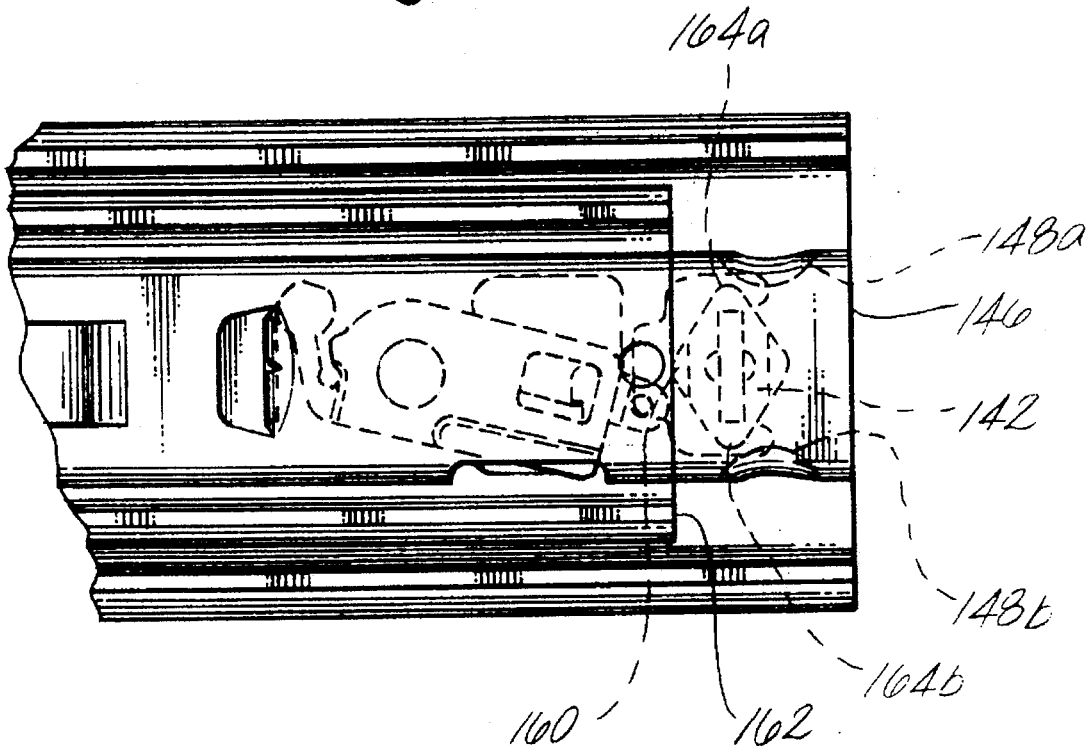
FIGS 3 is a partial inboard side elevational view of the drawer slide of FIG. 1, shown in a closed configuration.

As shown in FIGS. 2 and 3, just forward of its rear end 140, the proximal slide member carries an elastomeric bumper 142. The bumper has a slot which fits over a standard 144. The standard is lanced from the proximal slide member's web and bent to point inboard, perpendicular to the web, thus forming a hole in the web with the standard extending from a rear portion of the hole. As viewed from the inboard side of the slide, the bumper is of a diamond-like section with its longer diagonal oriented vertically.

As shown in FIG. 3, when the drawer is closed, the slide mechanism is in a fully retracted or nested configuration such that the distal slide member covers the bumper 142 just forward of the rear end 146 of the distal slide member. The top and bottom portions of the distal slide member are pinched vertically inward to create projections 148*a* and 148*b* , respectively. The projections are separated by distance slightly less than the vertical height of the bumper.

Figure 10B:
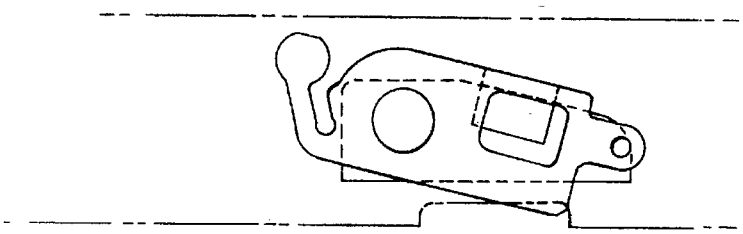
Figure 10A:
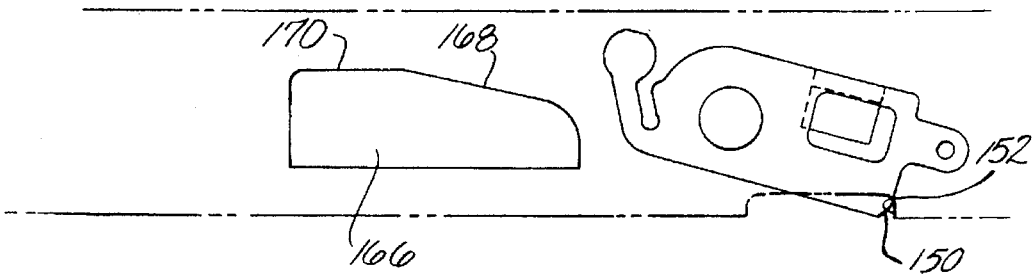

As shown in FIG. 2 and in an operative orientation in FIG. 10*a*, the latch has a beveled lower back corner 150 which, in the nested configuration extends into a slot formed in the lower raceway and bottom portion of the distal slide member. The rear end of the latch is engageable with the rear end 152 of the slot to restrict forward movement of the distal slide member relative to the intermediate slide member. The slotted raceway of the distal slide member thus serves as a locking element. In cases where the distal slide member is wider, a tab could be formed on the flat vertical web 76 (FIG. 5) to act as the locking element.

As shown in FIG. 2, a stop 154 is lanced from the distal slide member's web and bent to project in an outboard direction toward the intermediate slide member. The stop is vertically oriented and has a rear face 156 and a forward face 158. In the retracted configuration, the rear face 156 is engageable with the front contour 120*a* of the spring arm to restrict rearward movement of the distal slide member relative to the intermediate slide member. Rearward movement of the distal and intermediate slide members as a unit relative to the proximal slide member is prevented by the interaction of the forward corner 160 of the bumper with the rear end 162 of the intermediate slide member (FIG. 3).

When the drawer is to be withdrawn from the cabinet, the outward pull on the drawer is transmitted to the distal slide member. The projections 148*a* and 148*b* compress the upper and lower corners 164*a* and 164*b* of the bumper and slip over the corners, disengaging the distal slide member from the bumper and permitting its further forward movement. While this is occurring, the rear end of the slot engages the rear end of the latch. As the rear end of the slot is located below the rivet 96 and the rear end of the latch is only slightly off vertical, the engagement of the rear end of the slot and the rear end of the latch will not tend to rotate the latch upward (counterclockwise as shown in the drawings) and thus the upper plate portion of the latch will remain in contact with the horizontal shelf portion 134 and keep the intermediate and distal slide members engaged as a unit.

Figure 6:
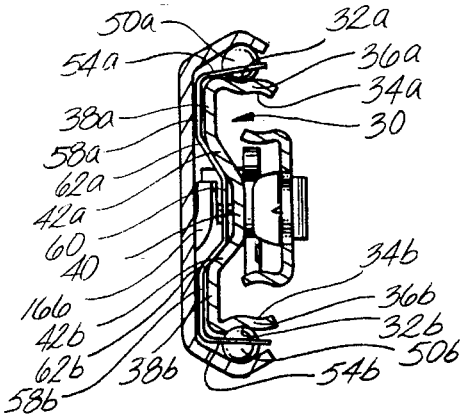
FIG. 6 cross-sectional view of the drawer slide of FIG. 2 taken along line 6—6.

The distal and intermediate slide members will continue to move forward as a unit until the latch engages an actuating ramp 166 (FIGS. 10*a* and 10*b*) which is lanced from the web of the proximal slide member. The ramp remains contiguous with the web along its lower edge and is bent inboard so as to be oriented substantially parallel to but inboard of the web (FIG. 6). The ramp has in inclined upper surface portion 168 which is engageable with the underside of the upper plate portion of the latch for activating the latch by rotating the latch counterclockwise so as to disengage the rear end of the latch from the rear end of the slot (FIGS. 2 and 10*b*). As the latch is rotated, the spring arm engages the rear face 156 of the stop 154 so that the body of the latch and spring arm are flexed toward each other. Once the latch is disengaged from the slot, the intermediate and distal slide members are no longer held together as a unit so that the distal slide member is free to extend forward of the intermediate slide member. With the latch fully disengaged (FIG. 10*c*), the underside of the upper plate portion will come to rest on a horizontal upper surface portion 170 of the ramp located immediately forward of the inclined upper surface portion 168.

From this orientation, any substantial further forward movement of the intermediate slide member is prevented by the interaction of a stop 172 (FIG. 2), lanced from the web of the proximal slide member adjacent its forward end and bent inboard, with a forward facing bumper 174 carried by the first bearing retainer. With the stop and bumper thus restricting further forward movement of intermediate slide member, the distal slide member is free to continue to move forward until the forward face 158 of the stop 154 of the distal slide member comes into engagement with a rear facing bumper 176 (FIG. 1) carried by the second bearing retainer.

If no sequencing is provided for the reinsertion of the intermediate and distal slide members, the two members will not necessarily retract in any given order. Such sequencing could be achieved by a modified latch mechanism (which will be described further below), a separate latch mechanism or, by designing the drawer slide so that greater amount of friction exists between, for example, the intermediate and proximal slide members.

However the reinsertion takes place, eventually the rear end of the intermediate slide member will come into contact with the bumper 142 so as to prevent further rearward movement of the intermediate slide member relative to the proximal slide member. This may occur either before or after the projections 148*a* and 148*b* pass over the upper and lower corners 164*a* and 164*b* of the bumper. In either case, once the rearward movement of the intermediate slide member is restricted and the projections have passed over the bumper, the interaction of the stop 154 with the spring arm will rotate the latch back into engagement with the slot if this has not already occurred (by force of gravity or otherwise).

It is also possible to provide for sequencing upon reinsertion of the slide by providing the ramp 166 with a notch or other feature to engage the latch and restrict rearward movement of the latch and thus the intermediate slide member. This is done, for example, by lowering the horizontal upper surface portion relative to the inclined upper surface portion of the ramp. In such a situation, to disengage the latch from the ramp, it is required to rotate the latch even further upward (counter clockwise as shown in the drawings). This is done, for example, by providing a projection extending downward from the upper portion of the distal slide member and located just to the rear of the stop 154. The projection, for example, interacts with the top of the spring arm (or an upward projection from the spring arm or latch body) to rotate the latch out of engagement from the ramp.

Figure 11:
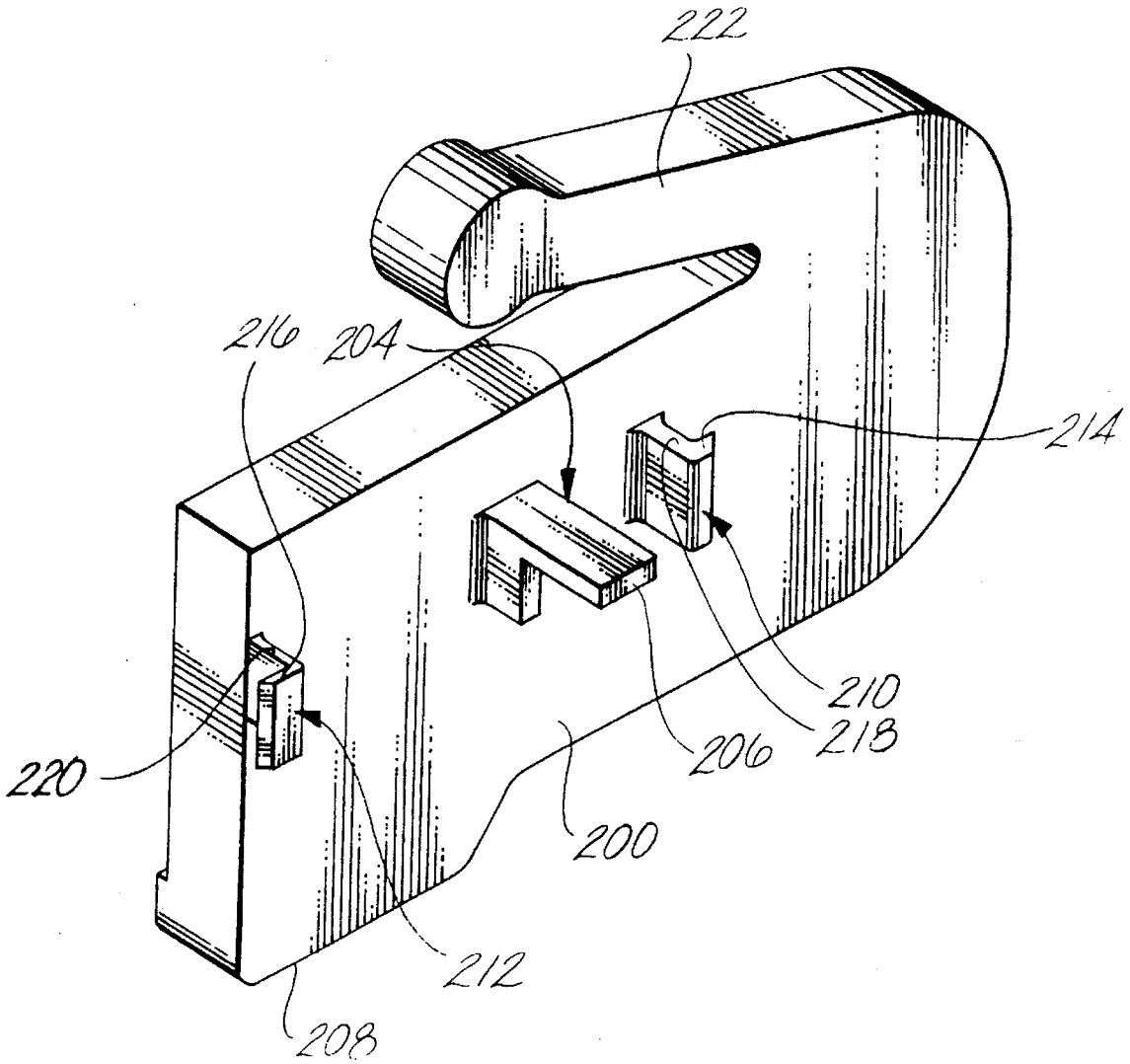
FIG. 11 is a perspective view of an alternate embodiment of a latch according to principles of the present invention.

Attachment of the latch may be accomplished by means other than a rivet. For example, a protrusion from the latch or intermediate slide member can provide a suitable rotation of the latch. It is additionally possible that the latch may be movable in a vertical plane by translation rather than by rotation (as is the latch of FIGS. 1–10). An exemplary embodiment of a latch which translates vertically is shown in FIG. 11. The illustrated latch has a planar outboard surface 200 which lies adjacent the inboard surface of the intermediate slide member. A projection 204 from the outboard surface has an upper plate portion 206 oriented substantially horizontally in extending perpendicular to the body of the latch. At the lower rear extremity of the latch, an engagement portion 208 depends from the latch body. The engagement portion of the latch may engage a slot in the distal slide member and the upper plate portion of the projection may engage a ramp formed on the proximal slide member, such as shown in the embodiment of FIGS. 1–10. Front and rear brackets of L-shaped section 210 and 212, respectively, project perpendicular to the latch body from its outboard surface and have foot portions 214 and 216 pointing forward and backward, respectively. The brackets 210 and 212 and projection 204 extend through one or more apertures in the intermediate slide member, with the front and rear faces of the leg portions 218 and 220 of the brackets 210 and 212, respectively engaging front and rear edges of the aperture(s). The edges may be oriented vertically or tilted slightly with upper portions located to the rear of the lower portions. The foot portions of the brackets interact with the outboard surface of the intermediate slide member to secure the latch to the slide member against lateral movement, however, the latch is vertically slidable. The latch may be gravity-operated, however, a sprung arm 222 may be provided to interact with the top portion of the distal slide member to further bias the engagement portion 208 into the mating slot in the bottom portion.

Although, a drawer slide having slide members and bearing retainers of specific configurations and proportions is shown, many different configurations are known and the present invention can be applied to or adapted for use with many such drawer slides.

Although, a left slide member, for use on the left side of a drawer, has been shown in the drawings, a right slide member could be constructed as a mirror image thereof. It is additionally noted, that if a suitable spacing is provided between the stop 154 (FIG. 1) and the rear end 152 of the slot, the latch will function if placed in an orientation upside down relative to that shown in the drawings. This is so because the interaction of the spring arm with the stop will prevent the force of gravity from rotating the latch out of engagement with the rear end of the slot. In such a case, the latch and other features of the right slide member need not be formed as a mirror image of those of the left slide member.

What is claimed is:

1. A slide mechanism comprising:

an outer slide member of a generally C-shaped section having a pair of upper and lower bearing raceways facing vertically inward;

an intermediate slide member of a generally C-shaped section having a pair of upper and lower bearing raceways facing vertically outward;

a first plurality of upper and lower bearings in rolling engagement with respective upper and lower raceways of the outer and intermediate slide members;

an inner slide member of a generally C-shaped section having a pair of upper and lower bearing raceways facing vertically outward;

a second plurality of upper and lower bearings in rolling engagement with the pair of upper and lower raceways of the inner slide member and a second pair of opposed vertically inward facing upper and lower raceways of the intermediate slide member;

a latch carried by the intermediate slide member, the latch engageable with a locking element on the inner slide member for restricting relative movement of the inner and intermediate slide members and engageable with an actuating element on the outer slide member for disengaging the latch from the locking element;

said latch comprising a unitarily formed combination of a substantially flat vertical body having a transverse pivot hole for pivotally mounting the latch to the intermediate slide member; and a projection extending transverse to the body for engaging the actuating element to pivot the latch;

said locking element comprising a raceway portion of the inner slide member having a slot for receiving a stop portion of the latch; and a spring arm connected to the body at a location below and forward of the pivot hole and extending forward and upward therefrom, the spring arm having a forwardmost surface located forward of and above the pivot hole for engaging a rear face of an inner slide stop on the inner slide member, and wherein the projection connects to the body at a location above and behind the pivot hole.

2. The slide mechanism of claim 1 wherein the projection extends through a hole in a web portion of the intermediate member and wherein the actuating element comprises a ramp engageable with the projection.

3. The slide mechanism of claim 2 wherein the ramp has an inclined surface and is punch formed in a vertical web of the outer slide member.

4. The slide mechanism of claim 1 wherein the stop portion of the latch is formed by a lower rear corner portion of the latch body engageable with a forward facing end of the slot and wherein the rear face of the inner slide stop is engageable with the forwardmost surface of the spring arm for rotating the stop portion of the latch into the slot.

5. The slide mechanism of claim 4 wherein upon relative extension of the inner and intermediate slide members from the outer slide member the ramp is engageable with the projection to rotate the stop portion out of the slot and flex the latch body toward the spring arm with the spring arm engaged to the rear face of the inner slide stop.

6. The slide mechanism of claim 1 wherein a forward face of the inner slide stop is engageable with a bearing retainer carrying the second plurality of upper and lower bearings for limiting relative extension of the inner slide member from the intermediate slide member.

7. The slide mechanism of claim 1 wherein the projection connects to the body at a location above and behind the pivot hole.

8. The slide mechanism of claim 7 wherein the projection comprises:

a rectilinear upper plate portion oriented substantially horizontally and extending transverse to the body adjacent an upper edge of the body;

a side plate portion extending downward from a lower surface of the upper plate portion and oriented substantially parallel to the body; and a connecting web portion extending between the side plate portion, the body and the upper plate portion adjacent a forward edge of the side plate portion.

* * * * *